United States Patent [19]

McHugh

[11] 4,109,861

[45] Aug. 29, 1978

[54] ELECTROSTATIC FLOCKING SYSTEM

[75] Inventor: John P. McHugh, Indianapolis, Ind.

[73] Assignee: Solar Suede Corporation, Lexington, Ky.

[21] Appl. No.: 724,029

[22] Filed: Sep. 16, 1976

[51] Int. Cl.[2] ..... B05B 5/02

[52] U.S. Cl. ..... 239/15; 239/143; 239/405; 302/51

[58] Field of Search ..... 239/15, 3, 85, 403, 239/404, 405, 143; 302/30, 46, 51; 222/195; 417/151

[56] References Cited

U.S. PATENT DOCUMENTS

| | | | |
|---|---|---|---|
| 749,206 | 1/1904 | Limbert | 302/51 |
| 982,923 | 1/1911 | Barby | 302/51 |
| 3,667,676 | 6/1972 | Watanabe et al. | 239/15 |
| 3,746,254 | 7/1973 | Duncan et al. | 239/15 |
| 3,870,232 | 3/1975 | Lacchia | 239/15 |
| 3,901,184 | 8/1975 | Payne et al. | 239/15 X |
| 3,903,321 | 9/1975 | Schaad | 239/15 X |
| 4,007,969 | 2/1977 | Aubin et al. | 302/46 X |
| 4,019,720 | 4/1977 | Levesque et al. | 302/30 X |
| 4,037,561 | 7/1977 | LaFave et al. | 118/629 |

*Primary Examiner*—Joseph F. Peters, Jr.
*Assistant Examiner*—Michael Mar
*Attorney, Agent, or Firm*—Jenkins, Coffey & Hyland

[57] ABSTRACT

An electrostatic flocking system having a hopper for gravitationally feeding flock fibers at a controlled rate to a pickup chamber in an air flow pump. The flow pump has a venturi inlet connector with a multi-branched outlet for delivering accelerated air into the pickup chamber. The pickup chamber has an arcuately recessed bottom wall to cause air from the inlet connector to swirl within the chamber to entrain the flock fibers and to carry them out of the flow pump via an outlet connector to an applicator gun. Conveniently, the flow pump has an auxiliary air inlet port opening into the pickup chamber to allow additional flock-entraining air to be pulled into the chamber by the air swirling therein. The applicator gun has a non-conductive outlet nozzle for reception into the front of the applicator gun, with a plurality of electrodes extending forwardly from the nozzle for electrostatically charging flock fibers passing therethrough. The outlet nozzle has an opening for passage of the flock fibers and entraining air stream, and that opening has a circular cross section at the rear of the nozzle for concentric alignment with the barrel of the applicator gun. The nozzle opening blends into a generally elliptical portion with an elongated axis increasing from the rear to the front of the nozzle so that the flock fibers and air stream are spread into a fan pattern. A diffuser bar extends along the shorter axis of the nozzle elliptical portion to enhance spreading of the exiting fibers and air stream. Conveniently, the exterior of the outlet nozzle has forwardly and inwardly sweeping concave sides so that additional flock-propelling air is drafted into the air stream exiting the nozzle to enhance fiber delivery to an article being coated.

8 Claims, 9 Drawing Figures

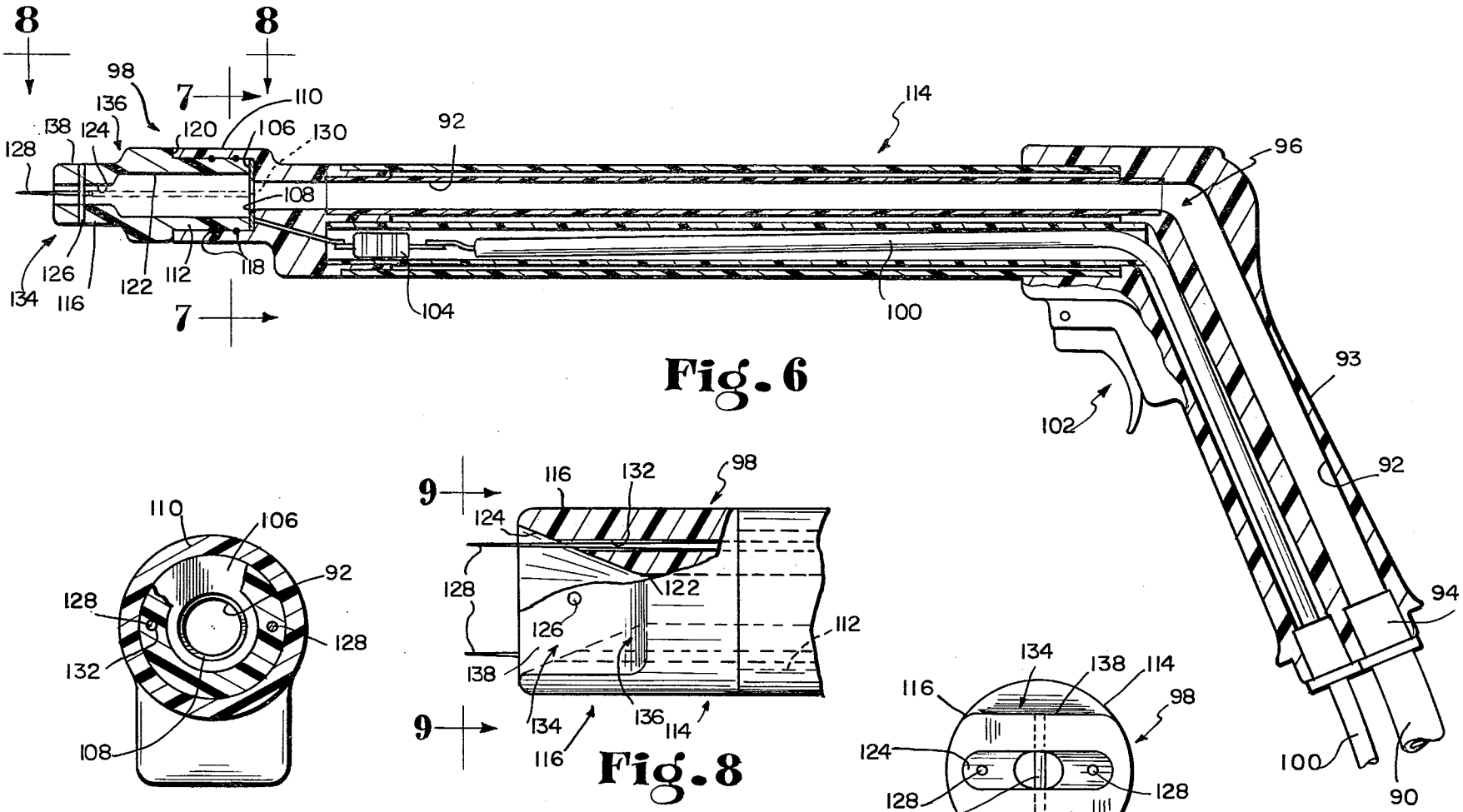
Fig. 6
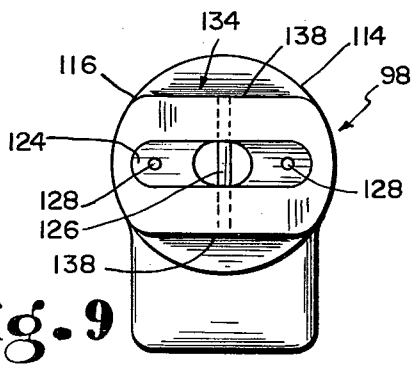
Fig. 9
Fig. 8
Fig. 7

ELECTROSTATIC FLOCKING SYSTEM

BACKGROUND OF THE INVENTION

This invention relates to electrostatic flocking systems. More specifically, this invention relates to improved apparatus for entraining flock fibers in an air stream and for delivering entrained flock fibers to an article being coated.

In the prior art, a wide variety of electrostatic flocking systems are well known. Typically, such systems comprise a vibratory hopper or a so-called fluidic bed for shaking flock fibers into a position for entrainment with an air stream which delivers the fibers to an applicator gun. It has been found, however, that prior art flock entrainment equipment requires undesirable quantities of air flow and excessive air pressures for delivery of continuous, uniform quantities of flock fibers to a gun. In fact, the high air flow requirements of prior art systems have usually required the entrained flock fibers and the propelling air stream to be separated at the applicator gun to prevent excessive quantities of the fibers from being blown past or bouncing off the article being coated. See, for example, U.S. Pat. No. 3,551,178.

The invention of this application overcomes the problems of the prior art by providing an electrostatic flocking system having an air flow pump for picking up relatively high quantities of flock fibers in a relatively low pressure entraining air stream. Further, the invention of this application provides a novel outlet nozzle for an applicator gun for use in combination with the low pressure air flow pump for assuring proper air and electrostatic delivery of flock fibers from the applicator gun to an article being coated.

SUMMARY OF THE INVENTION

In accordance with the invention, an electrostatic flocking system has a hopper for continuously delivering flock fibers at a controlled rate to an air flow pump. The fibers gravitationally fall into a pump pickup chamber having an arcuately recessed bottom wall. A stream of air at relatively low pressure is introduced into the pickup chamber through an inlet connector having an accelerating venturi constriction and a multi-branched tip within the pickup chamber. The entering air stream swirls within the pickup chamber to pick up and entrain the falling flock fibers. The swirling air flow is enhanced by one or more auxiliary inlet ports opening into the chamber bottom wall whereby additional flock-propelling air is drawn into the chamber by the already-swirling air therein.

The swirling air and the entrained flock fibers exit the air flow pump through an outlet connector, and travel through flexible tubing to and through an electrostatic applicator gun. The gun has an outlet nozzle at its forward end with a plurality of electrically charged, forwardly extending electrodes. The nozzle has an opening therethrough which has a circular cross section at the rear thereof for alignment with the barrel of the applicator gun. The circular portion of the opening blends into a generally elliptical cross section with an elongated axis increasing in length from the rear to the front of the nozzle. A diffuser post is carried along the shorter axis of the elliptical opening so that the center of the nozzle opening is blocked to cause the flock fibers and the air stream to spread out in a fan pattern upon exiting the nozzle. Delivery of the flock fibers to an article being coated is enhanced by forwardly and inwardly sweeping concave exterior nozzle side walls which enable additional propelling air to be drafted along with the air exiting the nozzle.

DETAILED DESCRIPTION OF THE DRAWINGS

The accompanying drawings illustrate the invention. In such drawings:

FIG. 6 is an enlarged side elevation view showing an applicator gun with an outlet nozzle for use with the system of this invention;

FIG. 7 is an enlarged vertical section taken on the line 7—7 of FIG. 6, with portions thereof broken away;

FIG. 8 is an enlarged fragmented top plan view of the outlet nozzle taken on the line 8—8 of FIG. 6, with portions thereof broken away; and FIG. 9 is a front elevation view of the outlet nozzle taken on the line 9—9 of FIG. 8.

DETAILED DESCRIPTION OF THE PREFERRED EMBODIMENT

Figure 1:
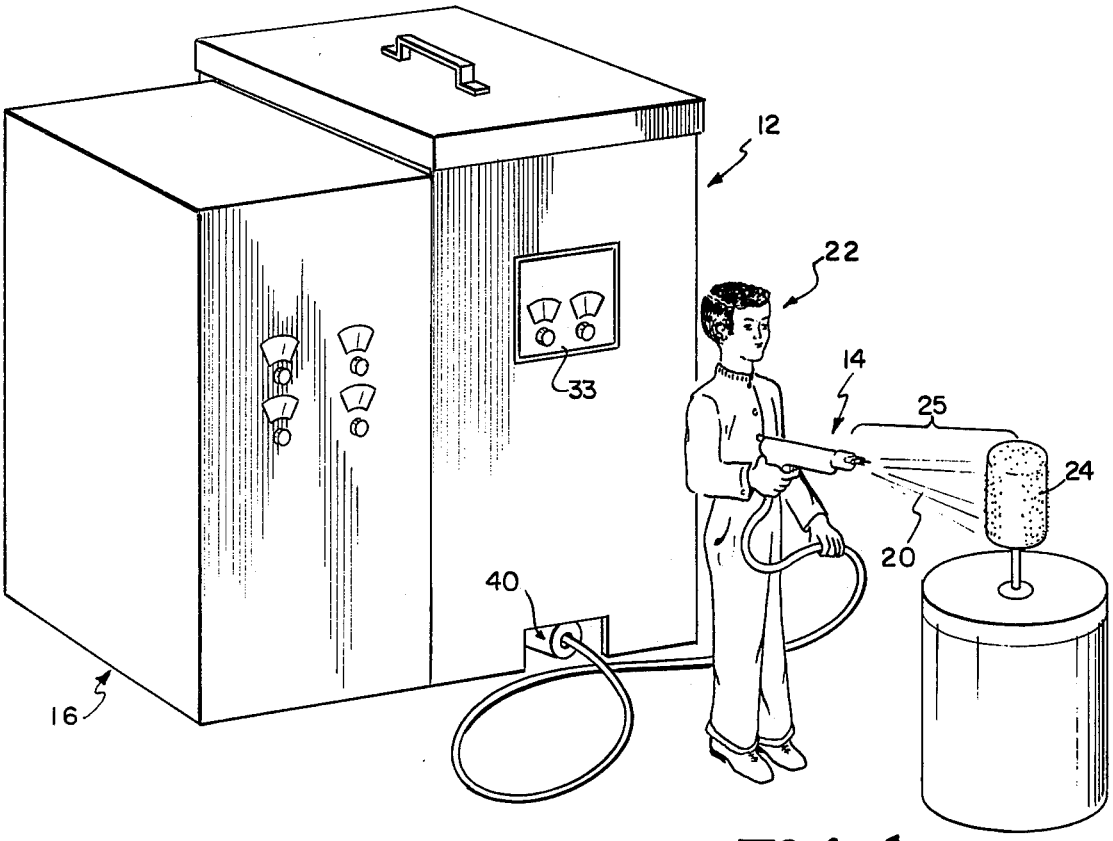
FIG. 1 is an elevation view illustrating the electrostatic flocking system of this invention.

Electrostatic flocking apparatus of this invention is shown in FIG. 1, and generally comprises a storage hopper 12 for holding a supply of flock fibers and for controllably delivering those flock fibers to a hand-held applicator gun 14. In practice, the fibers comprise a suitable fibrous material, such as nylon, and have an electrical resistance of from about $5 \times 10^5$ to about $1 \times 10^{11}$ ohms. The applicator gun 14 is supplied with electrical power from a high voltage D.C. power supply 16 for electrostatically charging the flock fibers 20 as they exit the gun. The gun is directionally controlled by an operator 22 who directs the spray of flock fibers 20 toward the surface of an article 24 being flocked. The article 24, which is pre-coated with an adhesive film, is electrically grounded (not shown) so that an electrostatic field 25 is set up between the gun 14 and article 24. In this manner, the positively charged flock fibers 20 are electrostatically attracted to the article 24 and are fixedly bonded thereto. Conveniently, the electrostatic field forces tend to draw the charged fibers to all sides of the grounded article 24 for coating of all surfaces thereof. Alternately, if desired, the gun can be mounted on a conveyor system or the like for continuously flocking a succession of articles.

Figure 2:
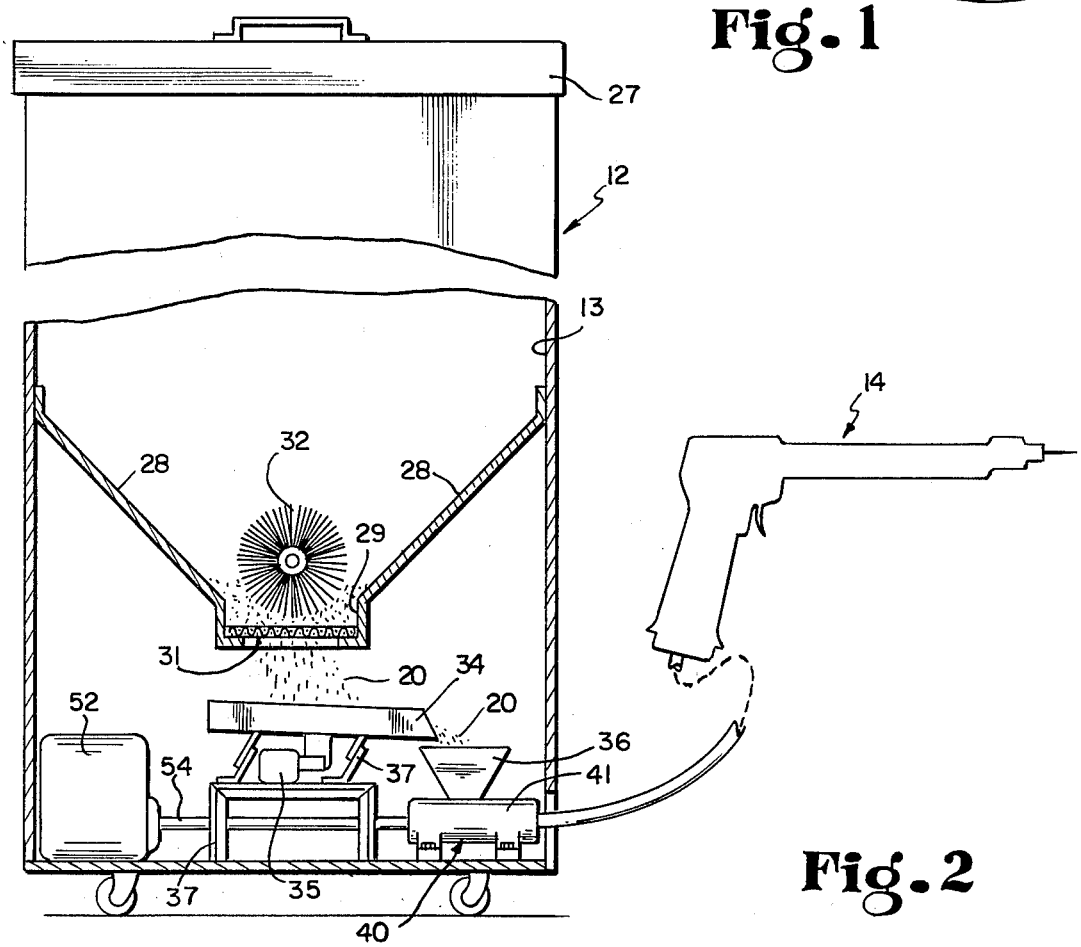
FIG. 2 is an enlarged fragmented elevation view of a flock hopper, with portions thereof broken away.

The hopper 12 is shown in detail in FIG. 2, and comprises a relatively large storage portion 13 covered with a removable lid 27 to permit the refilling thereof. The bottom of the storage housing 13 is defined by inwardly angled walls 28 whose lower ends are spaced from each other to form a fiber discharge opening 29 closed by a screen 31. The fibers are urged through the screen 31 by a brush 32 extending across the discharge opening 29 immediately above the screen and driven by an electrical motor 37 (not shown) controlled by a control panel 33 on the outside of the hopper.

The flock fibers 20 fall by gravity onto an elongated trough 34 which is mounted on floating supports 37 and vibrated by a vibratory motor 35. Importantly, the trough 34 is angled slightly downwardly toward one side so that flock fibers 20 thereon are shaken from the trough into a collecting funnel 36. Conveniently, the vibratory action of the trough 34 tends to break up any remaining clumps of fibers, and causes a substantial portion of the fibers to align themselves longitudinally as they move along the trough and fall into the funnel 36.

Figure 3:
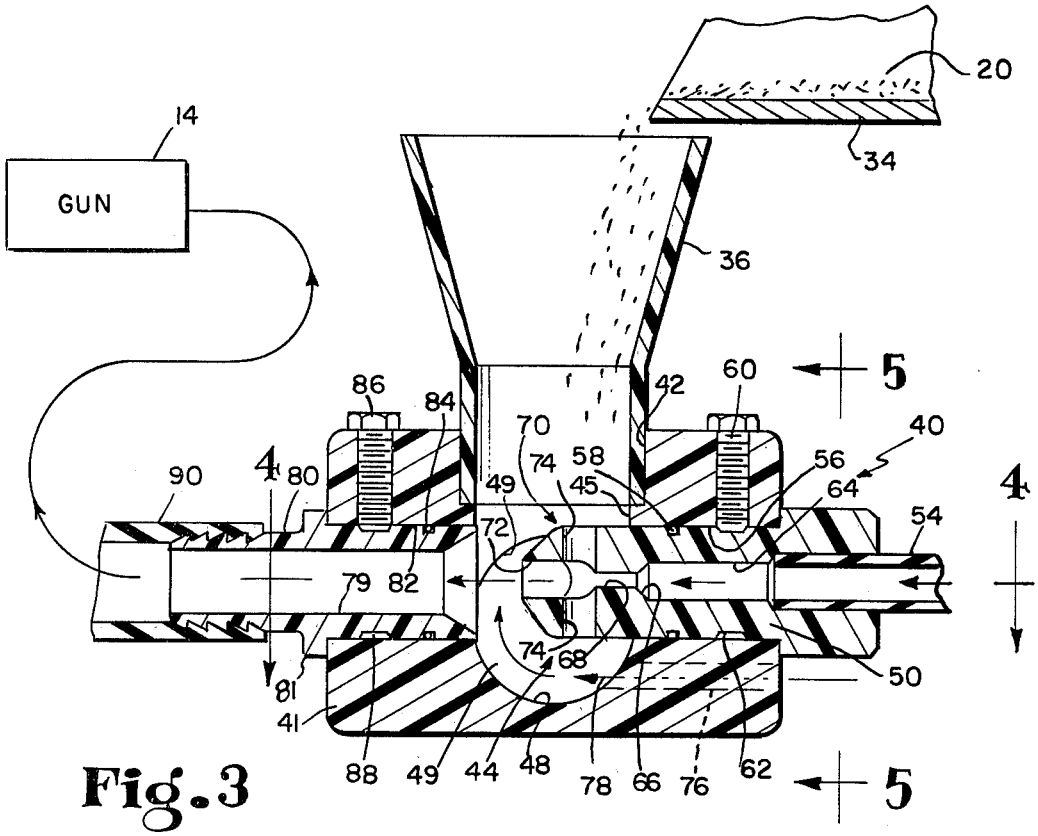
FIG. 3 is an enlarged fragmented elevation view of an air flow pump for use with the system of this invention.
Figure 4:
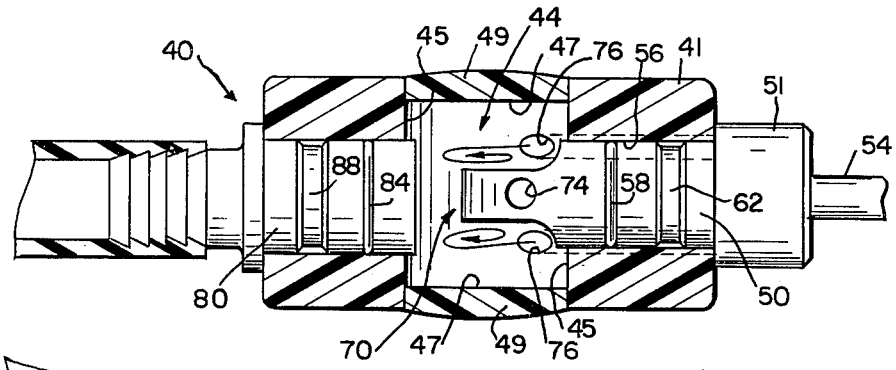
FIG. 4 is a horizontal section taken on the line 4—4 of FIG. 3.
Figure 5:
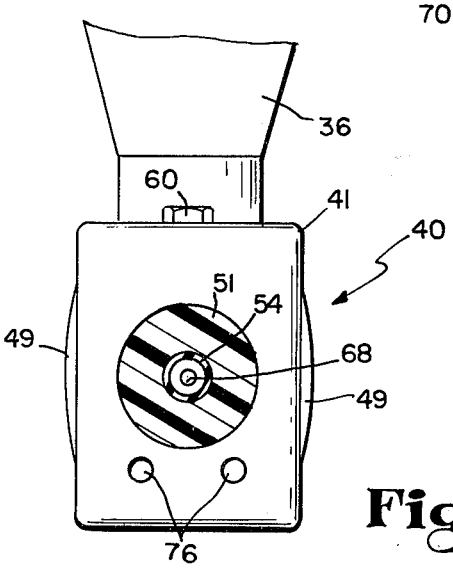
FIG. 5 is a fragmented vertical section taken on the line 5—5 of FIG. 3.

The funnel 36 continuously supplies the flock fibers 20 to an air flow pump 40 of this invention. More specifically, as shown in FIGS. 3–5, the pump 40 comprises a housing block 41, and the fibers 20 gravitationally fall through the funnel 36 and into a pickup chamber 44 in the housing block 41 through a pump feed opening 42. The pickup chamber 44 has flat, vertically extending opposed end walls 45 and opposed side walls 47. Importantly, the bottom wall 48 of the pickup chamber 44 is arcuately recessed so that the bottom wall 48 curves downwardly from the one chamber end wall 45 and then upwardly to the other chamber end wall 45. Conveniently, the arcuately recessed bottom wall 48 of the pickup chamber 44 is formed in the housing 41 by boring transversely through said housing. Then, the sides of the housing are closed by removable caps 49 having flat inwardly presented faces forming part of the vertically extending chamber side walls 47.

The air flow pump 40 is supplied with air under pressure from an air compressor 52, shown in FIG. 2, via tubing 54. In practice, the compressor 52 supplies air at from about four pounds to about twenty pounds pressure. The tubing 54 has one end snugly carried in an enlarged boss 51 of an inlet connector 50 which is slidably received into an inlet opening 56 in the air pump 40 with the boss 51 abutting one end of the pump housing 41. The inlet connector 50 has a circumferentially extending O-ring seal 58 carried thereon, and the connector is retained in position within the inlet opening 56 by a set screw 60 received in a peripheral recess 62.

Compressed air flows through a longitudinal channel 64 in the inlet connector 50, and is accelerated at a venturi constriction 66. The air flows from the constriction 66 through a narrow throat 68 into the pickup chamber 44 of the flow pump through a multi-branched tee 70. As shown, the tee 70 has one forwardly directed outlet channel 72, and two opposed vertically directed channels 74 opening directly into the pickup chamber 44. Thus, the accelerated air flowing through the venturi constriction 66 into the pickup chamber 44 is caused to turbulently swirl within the pickup chamber for the purpose of picking up and entraining the falling flock fibers 20. Importantly, this swirling air action is significantly enhanced by the arcuately recessed bottom wall 48 of the pickup chamber.

Additional air for picking up and entraining flock fibers 20 is introduced into the pickup chamber 44 through a pair of parallel auxiliary air inlet ports 76. These ports 76 are parallel with the longitudinal flow channel 64 of the inlet connector 50, and open into the arcuately recessed bottom wall 48 of the pickup chamber below the inlet connector tee 70. With this construction, the swirling air entering the chamber 44 through the inlet connector 50 draws additional air through the ports 76 in the direction of arrow 78 to increase the circulatory swirling action within the chamber. This additional air thereby inreases the pump capacity for picking up and entraining flock fibers, and thereby allows entrainment of the flock fibers at relatively lower air pressures than heretofore possible.

The air and entrained flock fibers exit the flow pump 40 through an opening 79 in outlet connector 80 in coaxial alignment with the inlet connector 50. The outlet connector 80 has a flange 81 for seating against the exterior of the pump housing 41, and is gas-sealably retained in position in a pump outlet opening 82 by an O-ring seal 84 and a set screw 86, which is received in peripheral recess 88. The outlet connector 80 directs the entrained flock fibers and propelling air stream into a length of flexible tubing 90 which carries the fibers and air to the applicator gun 14.

As shown in FIG. 6, the flock fibers 20 and the propelling air stream are fed through the tubing 90 into and through a barrel opening 92 in the applicator gun 14. Conveniently, the tubing 90 connects to the bottom of the gun handle 93 through a fitting 94 so that the fibers and propelling air travel first generally upwardly through the barrel opening 92, and then turn forwardly, as at 96, toward a gun outlet nozzle 98. This turning action serves to slow the fibers and the air stream before spraying thereof toward the article being coated to minimize the possibility of fibers being blown past or bouncing off the article being coated.

Electrical power for the gun 14 is supplied from the high voltage power supply 16 (FIG. 1) through a lead 100. This lead 100 conveniently couples to the bottom of the gun handle 93 alongside the flock tubing 90, and then extends upwardly and forwardly toward the outlet nozzle 98. The lead 100 is controllably interrupted by a manually operable trigger assembly 102, and is electrically coupled through a resistor 104 to an annular, conductive metal ring 106. The ring 106 has an inside diameter slightly greater than the diameter of the gun barrel opening 92, and is seated in alignment with the barrel opening 92 against a forwardly presented shoulder 108 within an enlarged cylindrical top 110 at the front of the gun.

The outlet nozzle 98 for the gun is formed from a suitable non-conductive material, and has a rear section 112, an intermediate section 114, and a forward section 116. The rear section 112 of the nozzle 98 is cylindrically shaped, and has a pair of O-ring seals 118 carried thereabout. The rear section 112 is sized for snug, slidable, push-in reception rearwardly into the tip 110 at the front of the applicator gun 14. The rear section 112 seats against the metal ring 106 to help retain the ring in position.

The rear section 112 of the nozzle 98 blends into the intermediate section 114 which also has a cylindrical shape. The intermediate section 114 is sized to have the same outside diameter as the tip 110 on the gun, and thereby provides a rearwardly facing peripheral abutment 120 for engaging the forward-most extent of the tip 110.

The rear and intermediate sections 112 and 114 of the nozzle together have a nozzle opening 122 of circular cross section formed therethrough and in alignment with the barrel opening 92 of the gun 14. This circular opening 122 blends at the juncture between the intermediate and forward sections 114 and 116 into an opening 124 of generally elliptical cross section, as shown in FIGS. 8 and 9. Importantly, the elliptical opening 124 has an elongated major axis dimension which increases from the rear to the front of the nozzle forward section, and a minor axis dimension which remains substantially constant. By way of example, in one embodiment of the invention, the major axis varied from about one-half inch to about one and one-half inches, and the minor axis was about one-quarter inch.

The forward section 116 of the nozzle 98 has a diffuser post 126 mounted along the minor axis of the elliptical opening 124. Thus, the flock fibers and the propelling air stream passing through the gun 14 are spread out in a fan-like pattern by the shape of the forward nozzle section 116. specifically, the central portion of the elliptical nozzle opening 124 is blocked by the diffuser post 126 so that the air and fibers fan out along the major axis of the elliptical opening to assume a low profile fan spray pattern. Importantly, while the pattern will spread out horizontally when the nozzle 96 is oriented as shown in FIGS. 6–9, it should be understood that the angular orientation of the spray pattern is variable by rotating the nozzle 98 with respect to the tip 110 at the front of the gun.

As shown in FIGS. 6–9, two electrodes 128 are provided for electrostatically charging flock fibers as they exit the nozzle 98. Each electrode 128 has a conductive bead 130 at its rear end, and extends forwardly through a small hole 132 formed through the rear, intermediate, and forward sections 112, 114, and 116 of the nozzle 98. Thus, the beads 132 are retained against the metal ring 106 by the nozzle rear section 112 so that the electrodes 128 are electrically coupled to the power supply. The electrodes 128 each extend into the elliptical nozzle opening 124 intermediate the longitudinal extent thereof, as shown in FIG. 8, and project forwardly for a short distance beyond the nozzle. In this manner, the spreading flock fibers are carried past the electrically charged electrodes 128 upon exiting the nozzle 98 so that the fibers are electrostatically charged and an electrostatic field is set up between the gun 14 and the article being coated. Importantly, the fibers are carried toward the article being coated both by the effects of the electrostatic field and by the propelling action of the air stream passing through the gun.

Air flow from the gun 14 toward the article being coated is enhanced by the exterior configuration of the forward section 116 of the nozzle 98. Specifically, the nozzle forward section 116 has opposed exterior sides 134 parallel with the major axis of the elliptical opening 124. Those opposed sides each sweep concavely inwardly and forwardly, as at 136, and then have flat surfaces 138 extending to the nozzle front. With this shape, air passing through the nozzle 98 creates a drafting effect along the opposed nozzle sides 134 to pull additional air into the flock-entraining air stream. This increase in the amount of propelling air increases the ability of the gun and nozzle to effectively deliver relatively high quantities of flock fibers to an article being coated in a relatively short period of time. The additional air also combines with the air flow pump 40 described above to enable the system to entrain and deliver flock fibers at still lower air pressures and volumes.

The electrostatic flocking system of this invention can be modified in a number of ways without departing from the scope of the invention. For example, the sizes and dimensions set out above are by way of illustration, and can be varied according to the specific compressor air pressure and the characteristics of the flock fibers. Further, for instance, the exact position of the tee 70, shown in FIG. 3, within the pump pickup chamber 44 can be varied according to the degree of swirling action required to entrain the particular flock fiber being used. Moreover, the tee 70 can be modified to have a pair of outlet channels disposed angularly to each other to create the desired swirling action within the pickup chamber.

I claim:

1. An electrostatic flocking system comprising an air flow pump having a central chamber with an air inlet and, a flock inlet, opening into said chamber and a chamber outlet connected with said chamber; said air inlet having a forwardly directed channel and a plurality of angularly disposed channels opening into said chamber and means in said inlet for accelerating air passing through said air inlet into said chamber; air supply means for supplying air through said air inlet into said chamber; flock supply means for supplying flock fibers through said flock inlet into said chamber; said chamber having an arcuately recessed bottom wall; an auxiliary air inlet port spaced from said air inlet and opening into the recessed portion of the bottom wall of the chamber; said flock fibers being entrained with the air in said chamber and exiting the chamber with the air through said outlet; an applicator gun having a barrel opening formed therethrough; means interconnecting said outlet and said gun at one end of the barrel opening of that the air and entrained flock fibers pass through the barrel opening; and charging means on said gun for electrostatically charging the flock fibers passing through the barrel opening.

2. An electrostatic flocking system as set forth in claim 1 wherein a pair of auxiliary air inlet ports open into said recessed bottom wall of the chamber parallel to each other and to the path of movement of air flowing through said air inlet.

3. An electrostatic flocking system comprising an air flow pump having a central chamber with a flock inlet opening into the top of said chamber and an air inlet and an outlet coaxially opening into opposed ends of said chamber, said air inlet having a venturi forwardly directed tube therein for accelerating air passing therethrough and a plurality of transversely disposed channels opening into said chamber, said chamber having an arcuately recessed bottom wall; air supply means for supplying air through said venturi tube into said chamber; flock supply means for supplying flock fibers through said flock inlet into said chamber; an auxiliary air port opening into the recessed portion of the bottom wall of the chamber below said air inlet, said flock fibers being entrained with the air passing into said chamber and exiting the chamber with the air through said outlet; an applicator gun having a barrel opening formed therethrough; means interconnecting said outlet and said gun at one end of said barrel opening so that the entrained flock fibers and air pass through the barrel opening; a nozzle on said gun at the other end of said barrel opening whereby the entrained flock fibers and air pass through said nozzle upon exiting the gun, said nozzle having opposed exterior side walls concavely sweeping axially inwardly and away from said gun whereby the entrained flock fibers and air exiting the nozzle cause additional air to be drafted along said side walls and to be carried with said exiting flock fibers and air; and charging means on said gun for electrostatically charging the flock fibers passing through the barrel opening.

4. An electrostatic flocking system as set forth in claim 3 wherein the bottom wall of said chamber is recessed arcuately downwardly from one end of said chamber and then upwardly to the other end of said chamber.

5. An air flow pump for entraining flock fibers in an air stream comprising a housing having a central chamber with a flock inlet opening into said chamber, said chamber having an arcuately recessed bottom wall; a chamber outlet connected with said chamber; means for directing air into said chamber, said means having a venturi for accelerating air directed into said chamber and a multi-branched tee having a forwardly directed outlet channel and a plurality of channels disposed transversely thereto in communication with said venturi and opening into said chamber whereby accelerated air passing through said venturi enters said chamber; and an auxiliary air inlet port opening into the recessed portion of the bottom wall of the chamber offset from said venturi and generally parallel to the path of movement of air passing through said venturi; the air entering said chamber through said venturi and through said auxiliary air inlet port creating a swirling effect within said chamber to entrain flock fibers therein and to carry them out of the chamber through said outlet.

6. An air flow pump as set forth in claim 5 wherein said air inlet means comprises an inlet connector having said multi-branched tee at one end and within said chamber, said tee having a plurality of angularly disposed channels in communication with the venturi and opening into said chamber.

7. An air flow pump as set forth in claim 5 wherein a pair of auxiliary air ports open into the recessed bottom portion of said chamber parallel to each other and to the path of movement of air flowing through said venturi.

8. An air flow pump for entraining flock fibers in an air stream comprising a housing having a bottom wall, opposed end walls, and opposed side walls forming a central chamber with a flock inlet opening into the top thereof, said bottom wall being arcuately recessed between said opposed end walls; an air inlet opening into said chamber through one of the housing end walls, said air inlet having a forwardly directed venturi for accelerating air passing therethrough and a vertical channel therethrough providing a plurality of openings into said chamber; and an outlet connected with said chamber through the other of the housing end walls and coaxially aligned with said air inlet, said housing having an auxiliary air inlet port opening into the arcuately recessed bottom wall of said chamber below said air inlet and generally parallel thereto, whereby air passing through said venturi and air passing through said auxiliary air inlet port enters said chamber and swirls therein to entrain flock fibers and to carry them out of said chamber through said outlet.

* * * * *

UNITED STATES PATENT OFFICE

CERTIFICATE OF CORRECTION

Patent No. 4,109,861 Dated August 29, 1978

Inventor(s) John P. McHugh

It is certified that error appears in the above-identified patent and that said Letters Patent are hereby corrected as shown below:

Column 6, lines 39 and 40, (Claim 3), change "venturi forwardly directed" to --forwardly directed venturi--.

Signed and Sealed this

*Third* Day of *April 1979*

[SEAL]

*Attest:*

RUTH C. MASON
*Attesting Officer*

DONALD W. BANNER
*Commissioner of Patents and Trademarks*